United States Patent [19]

Hunter

[11] 4,318,088

[45] Mar. 2, 1982

[54] SECURITY FENCE SYSTEM

[76] Inventor: Kent Hunter, R.R. #1, Frost Mill Rd., Mill Neck, N.Y. 11765

[21] Appl. No.: 97,006

[22] Filed: Nov. 23, 1979

[51] Int. Cl.[3] ..... G08B 13/22

[52] U.S. Cl. ..... 340/541; 256/10; 256/48; 174/158 F

[58] Field of Search ..... 256/10, 48, 50; 174/158 F, 161 F, 163 F, 159, 154, 155; 340/564, 541

[56] References Cited

U.S. PATENT DOCUMENTS

| | | | |
|---|---|---|---|
| 1,483,005 | 2/1924 | McNair . | |
| 2,350,290 | 5/1944 | Moore | 256/10 |
| 2,364,994 | 12/1944 | Moore | 256/10 |
| 2,398,442 | 4/1946 | Moore | 256/10 |
| 2,421,771 | 6/1947 | Browning . | |
| 2,512,740 | 6/1950 | Evans . | |
| 2,530,247 | 11/1950 | Koonz | 256/10 |
| 3,047,849 | 7/1962 | Hansen . | |
| 3,230,518 | 1/1966 | Vassil et al. . | |
| 4,155,083 | 5/1979 | Slaats et al. | 256/10 X |
| 4,196,890 | 4/1980 | Einhorn | 256/10 |
| 4,220,949 | 9/1980 | Pope et al. | 256/10 |

FOREIGN PATENT DOCUMENTS

| | | |
|---|---|---|
| 344983 | 9/1904 | France . |

*Primary Examiner*—Andrew V. Kundrat
*Attorney, Agent, or Firm*—Nolte and Nolte

[57] ABSTRACT

A security fence system in which single-strand wires are arranged in pairs and stretched between conventional fence posts. Electrical current is passed through the pair of wires which are arranged such that upon disturbing the wires by attempting entry into the fenced area the current path will be altered, the condition sensed by a detection device, and an alarm is set off.

12 Claims, 5 Drawing Figures

SECURITY FENCE SYSTEM

BACKGROUND OF INVENTION

The present invention relates to security fences and specifically relates to security fences having electrical detection devices incorporated therein.

Fences have been in existence ever since man first wanted to keep something in or out of a specified area. Electrified fences have also been known for a long time, and these fences are generally of the kind in which the body contacting the fence receives an electrical shock, thus, being prevented from entering or exiting the fenced area. This fence was an improvement over the old barbed-wire fence used to fence the open range of the United States.

Presently, one of the most popular fences is the cyclone fence or chain-link fence, which is a relatively massive metal structure which physically prevents any passage through the fence. Electrification of this type of fence is somewhat cumbersome; however, U.S. Pat. No. 2,530,247 describes one manner in which this may be accomplished.

Another kind of fence, which may be thought of as being electrified, is the intrusion detection fence which utilizes coaxial cable or the like in combination with an oscillator or RF generator to create an electric field which is part of a tank circuit. The resonance of the tank circuit will change when the circuit is detuned by the proximity of the body of an intruder. The kind of security system normally is complicated and expensive and must also rely upon another fence, or security personnel, to provide the actual physical prohibition of the intruder. Cyclone fences and electronic intrusion detection systems are expensive when the perimeter of the area to be fenced is more than that normally associated with a private dwelling.

SUMMARY OF THE INVENTION

The present invention provides a fence which is formed of two electrically conducting single wire strands arranged substantially parallel with the ground and which carry a low amperage current in their undisturbed state. The wires are arranged in such proximity and are formed of such a gauge wire that passage through them without disturbing their normal relaxed state is impossible. The two wires are arranged in a pair with such a polarity that when they are disturbed by an intruder, adjacent wires of opposite polarity will come in contact with each other and, this situation will be detected by a suitable detection device.

A special advantage of the present invention is that, although an electric current is passing through the wires forming the fence, such current is not sufficient to impart a harmful shock to any person touching the wires. Therefore, the inventive fence does not pose a danger to children or animals. Additionally, because these wires are carrying only a low current and are not the kind of wire which would typically look like an electrified fence, an intruder is not likely to assume that the fence is connected to an electronic detection system and, thus, will quite frequently stretch the wires and cause electrical contact to be made, thereby activating an alarm.

The inventive detection device has an adjustable threshold level such that certain deviations from the normal current flowing in the fence will be detected, in this manner the present invention self-monitors its own integrity.

Therefore, it is an object of the present invention to provide a security fence system which mechanically prevents intrusion and employs an electrical detection system which detects when an intrusion is occurring.

It is another object of the present invention to provide a security fence system which employs inexpensive single strand steel wire which may be arranged on inexpensive wooden posts in conjunction with a solid-state detection device to provide an inexpensive security fence system.

It is a further object of the present invention to provide a security fence system employing a detection device which will actuate an alarm when a deviation from a preset electrical threshold is detected.

DETAILED DESCRIPTION OF THE INVENTION

Figure 1:
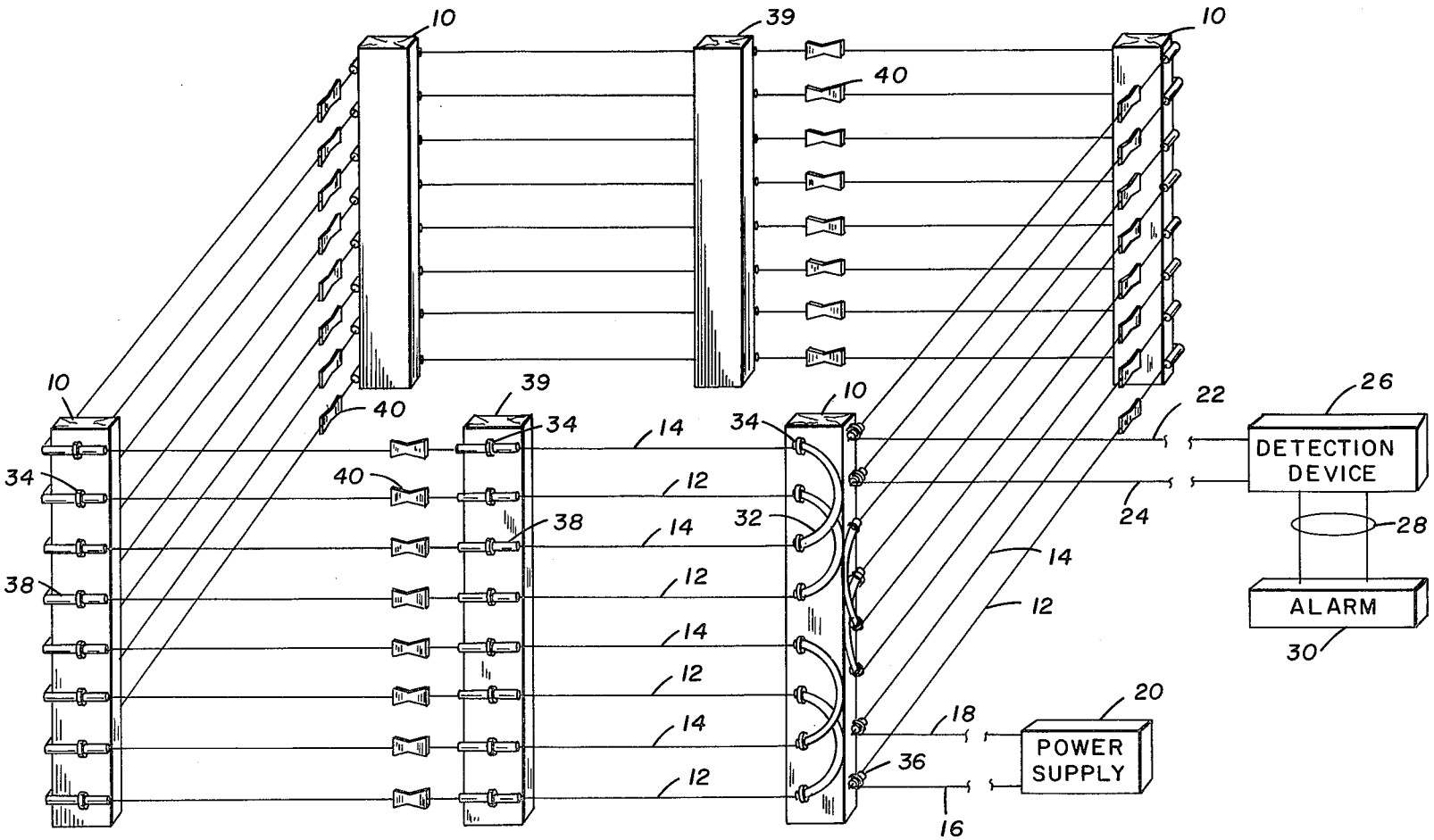
FIG. 1 is a perspective of a typical installation of the inventive system.

Referring now to FIG. 1, a typical installation of the present invention is shown. A series of pressure-treated wooden posts 10 are sunk into the ground in the conventional manner and, typically, the posts define the area to be protected. The posts may be round or square wooden posts or, alternatively, steel posts may be employed. A number of single-strand steel or galvanized steel wires ae affixed to the posts and arranged parallel to the ground. Although a plurality of wires are apparently utilized, there are actually only two continuous, individual wires, 12 and 14, shown in FIG. 1. The bottom-most wire 12 is first fixed at the lower-most point of the fence and is then attached to each of the posts defining the fenced compound. These two wires, 12 and 14, are serially affixed to each post 10 until they circumscribe the fenced area, whereupon the direction is reversed. The wires are then affixed serially to the posts in the direction opposite to the first time around and upon circumscribing the area are reversed once again; this continues until the top of the fence is reached. The initial ends of the two wires, 12 and 14, are connected via electrical wires 16 and 18, respectively, to a power supply 20, which will be discussed in more detail hereinbelow. At the ends of these two wires, 12 and 14, additional electrical wires, 22 and 24, respectively, are connected to a detection device 26, whose operation will be explained hereinbelow. The detection device 26 is connected via lines 28 to an alarm unit 30, which audibly and/or visually indicates the presence of an intruder to the monitoring personnel.

The two wires, 12 and 14, employed in this particular embodiment must be arranged on the fence posts 10 in a particular order. Specifically, like wires should never be arranged adjacent one another, thus, upon reaching the last post of the fence, the two wires must be shifted upwardly and permitted to cross, thereby causing the bottom-most wire to be adjacent the top-most wire in the next row of wires. The manner in which this is accomplished will be shown in more detail in FIG. 2. However, the two wires are reversed and crossed over by means of insulators, one of which is shown typically at 32.

These insulators 32 are firmly affixed to the fence post 10 by means of specialized staples, shown typically at 34. The insulators 32 are slit so that they may be installed over the fence wire and then affixed to the fence post. In place of this kind of insulator, a channel-shaped, extruded insulator could be employed. An insulator 32 is employed because it has been found through experimentation that it is necessary to isolate electrically the wires from the fence posts. This is also a requirement when using wooden fence posts, since it has been found that pressure treated fence posts tend to conduct electricity due to the conductive abilities of the chemical-impregnated wood. The staples 34 and insulators 32 serve to hold firmly the wire against the post and to prevent any slipage at that point in the fence. Similarly, tubular insulators, one of which is shown typically at 36, are employed along with the specialized staples 34 to firmly affix the ends of the two continuous wires, 12 and 14, to the fence post 10. The posts 10 may be separated by any distance up to 30 feet; however, 20 feet has proven to be most efficient when using 14-gauge wire. The wires, 12 and 14, can be separated by a distance of anywhere from 2 to 6 inches, with 3 inches being a very workable separation.

Because it is an object of the present invention to provide a fence which sets off an alarm an intruder spreads the wires so as to step or reach through, it is necessary that the wires not be firmly affixed to the intermediate posts but be permitted to slip through the affixing means, yet still be electrically insulated from the post. Accordingly, the specialized staples 34 are used with tubular insulators 38 to attach the wires loosely to the intermediate posts 39. Additionally, because the wires will tend to relax and sag once they are installed, tensioners 40 are usually necessary in order to keep the wires separated by the desired distance. Any type of tensioner may be employed and, in fact, simply wrapping the wire around a wood stick may suffice to take the slack out of the wires.

Figure 2:
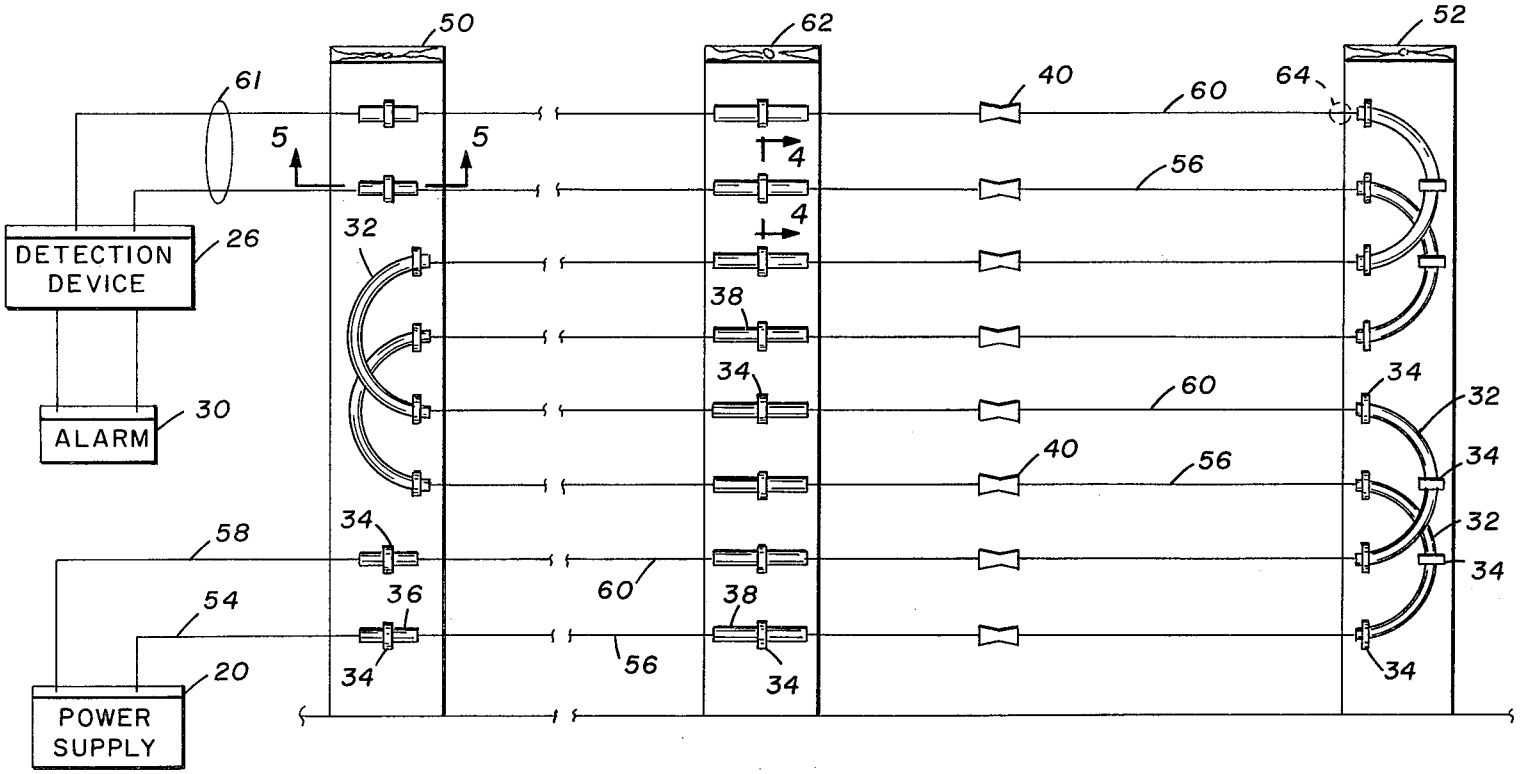
FIG. 2 is a perspective of another typical installation of the present invention.

Referring now to FIG. 2, a fence similar to the inventive fence of FIG. 1 is shown. Because it is a requirement that each wire in the fence must be stretched tightly between the firmly affixed locations, represented by posts 50 and 52, tensioning devices 40 are necessary for each discrete section of fence. Therefore, if there are directional changes in excess of approximately 20 degrees, such as at the corners of the corral arrangement shown in FIG. 1, it is necessary that the wires be firmly affixed at each corner and a tensioning device must be placed in each fixed segment.

The present invention requires that each wire not touch any other wire under the pressure of sagging, high winds, ice storms or any such normal occurrence. The electrical power employed is preferably of low voltage, e.g., approximately 6 volts DC, and should result in an extremely low current of approximately 5 to 10 milliamps. In this example, the power supply 20 is connected via line 54 to the lower fence wire 56 and via line 58 to the upper wire 60. The wires, 56 and 60, are initially firmly affixed to post 50 by means of tubular insulators 36 and specialized staples 34. The two wires, 56 and 60, are then strong to an intermediate post 62, where they are fastened to the post 62 in a manner which will permit a wire to slip through yet still be insulated from the post 62, by means of the specialized staple 34 and tubular insulator 38. The wires then pass through appropriate tensioning devices 40, which take the slack out of the wires once they are firmly affixed to post 52. At post 52, the specialized staples 34 are used once again to fasten the wires to the post.

It may be seen by tracing the wires, 56 and 60, that wire 56 enters at the bottom-most point and is passed through the insulator 32 and is arranged adjacent to, but above, the top-most wire 60 of the original pair. An insulator 32 is also used over the end of wire 60 and wire 56 is then passed over the insulated portion of wire 60, so that it is above wire 60. Similarly, wire 60 is then passed upward so that it is now above original wire 56.

The exact same upward shifting and direction reversing operation is performed at the other end of the fixed section, i.e., at post 50. This operation is then simply repeated until the fence is completed to the desired height. The detection device 26 is connected to the two fence wires in the same manner as was the power supply 20, i.e., by means of a pair of electrical conductors 61, which are connected to the fence wires, 56 and 60, after they have been firmly affixed to post 50 by insulators 36 and staples 34. It should be understood that although in the example of FIG. 2, the top-most wires are connected to the detection device, if desired the top-most wires could be connected to an adjacent fixed fence section and any number of fixed fence sections could be connected together in series in this manner. However, by use of the approach of FIG. 2, with an alarm being provided for each fixed section, then the capability is provided to accurately determine the exact location of the attempted break-in. Thus, the more detection devices employed the higher the accuracy in determining the exact location of the break-in, i.e., the greater the resolution. Additionally, it is possible that each horizontal fence wire may be a discrete wire strung separately, with the necessary electrical connections being made at the ends by way of jumpers or the like soldered onto each wire. This, however, provides the possibility for contact deterioration and increased resistance, thereby making the fence less reliable than by using two continuous unbroken lengths of wire, as shown in FIGS. 1 and 2.

As still another alternative, the fence could be horizontally zoned with each horizontal pair being provided with a detection device. In this way, if it was known that there was snow covering the bottom-most pair, or high weeds interfering with such pair, the bottom zone could be turned off to prevent false alarm signals.

The power supply 20 may comprise any readily available 6 volt current source and may simply be a battery, or an AC operated DC power supply could be employed. The power supply may be provided with an overload protection means, so that when an intruder would cause two wires to short together, thereby setting off the alarm, the power supply will not be damaged. However, the power supply should not be provided with a circuit breaker which would drop it out of the line, since it is a feature of the present invention that even though the alarm has been rung or lit the fence still remains operational and ready to detect further intruders. Moreover, although the embodiment described herein employs a DC power supply in combination with the appropriate detector, an alternating current power supply may also be advantageously employed.

The detection device 26 detects either of two important situations. First, if any of the fence wires are cut the cessation of the flow of current will be immediately detected by the detection device 26 and the alarm 30 will be set off. Additionally, upon an intruder stretching or separating the wires so that two adjacent wires touch, this change in the magnitude of the current will also be immediately detected by the detection device. However, the fence can be touched or impacted by leaves, light branches, snow, and rain without registering any alarm condition. The detection device 26 monitors the current passing through the wires forming the fence. Thus, the detection device can include a load resistor which is connected across the ends of the two wires, 12 and 14 of FIG. 1 or 56 and 60 of FIG. 2, and a conventional current detector which may be formed of a shunt resistor, a voltmeter connected to determine the voltage across the shunt resistor, and a means to compare the detected voltage to a reference voltage, as determined by a variable resistance reference resistor. In place of several of these components, it is desirable to use a solid-state comparator to detect when the sensed current is above or below a selected threshold level. Alternatively, the detection device may also comprise an electromechanical system employing a relay wherein changes in the current will affect the ability of the coil of the relay to hold the contacts and, thus, cause it to either pull in or drop out. When utilizing a comparator to determine the current flowing in the fence wires, the output of the comparator may be connected to a solid-state flip-flop device which has its "set" input connected to the output from the comparator indicating that a current abnormality is present. The flip-flop output could then drive the coil of a relay to close the contacts necessary to activate the alarm. The alarm may be a bell, a light, a buzzer, or a signal sent to a police station.

Figure 3:
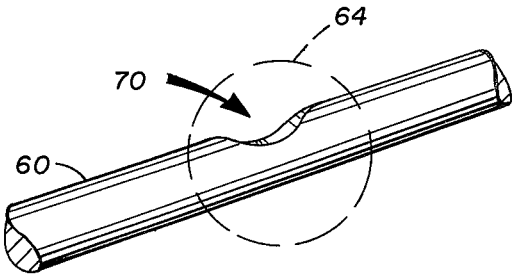
FIG. 3 is a perspective of a portion of the fence wire of FIG. 2.

As a further improvement of the present invention and as a means to increase the security of the present system, it is possible to notch or remove some of the metal forming the individual wires at selected locations. Although this feature will decrease the physical strength of the fence, it will almost surely cause the wire to break when stretched apart by an intruder, thereby setting off the alarm. The apparent visual strength of the fence, however, will not be affected if the notches are placed where they will not be easily noticed by an intruder. Notching of the wires will prevent the intruder from insulating the wires in such a manner that they may be all stretched apart and retained in their stretched apart arrangement and then proceeding with the break-in. By notching the wires and removing the metal, the tensile strength of the wire is proportionately diminished and thus, upon insulating the wires and attempting to stretch them, the wire will break. Additionally, it should be noted when utilizing the notched wires that they should be notched between each post and that they should be firmly affixed to all of the intermediate posts. By firmly affixing the wires to all of the posts, the wire will break at the point of the notch rather than be allowed to stretch over the entire section. The location of a notch is shown by the dashed circle at 64 and FIG. 3 shows the wire 60 being notched at location 70. It should be notched that a deformation of the metal is not desired when notching the wire, i.e., such as might be achieved by a wire cutter but, rather, metal should actually be removed by a small hand-operated grinding wheel, milling tool, or hack saw.

Figure 4:
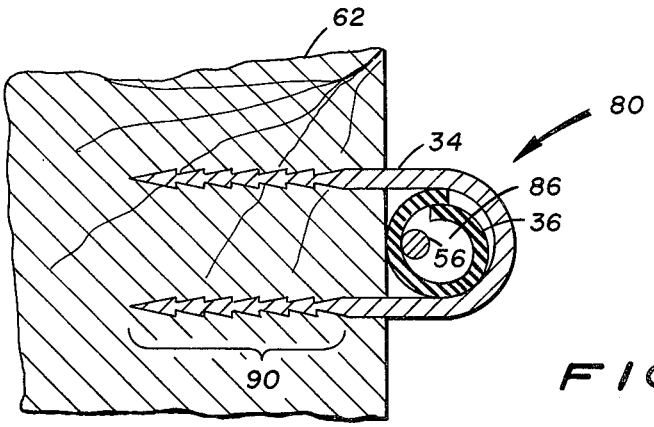
FIG. 4 is a side elevation in cross section taken along section lines 4—4 of FIG. 2.

FIG. 4 shows a cross section of the feed-through staple 34 and insulator 38 of FIGS. 1 and 2. This assembly 80 comprises an outer metal staple 34, which has as an insert a plastic tubular insulator 38 with a central aperture 86 substantially larger than the diameter of the wire 56 being employed. The insulating insert 38 should be split or provided with some sort of a channel which will permit the wire to be inserted into the aperture 86. The staple 34 is provided with barbed or serrated ends, shown typically at 90, which serve to make the staple a one-way staple, whereby it is very difficult to remove the staple once it is imbedded into the post 62. This is desirable in order to prevent an intruder from removing all of the wires from the post, thereby giving sufficient slack so that he may insulate and separate the wires and gain access to the fenced area. The aperture 86 must be substantially larger than the diameter of the wire, so that the wire will slip easily through the assembly 80. In this manner, after an intruder has stretched and insulated the wires, upon releasing same the wires will slip through the assembly 80 and make electrical contact with each other and sound the alarm.

Figure 5:
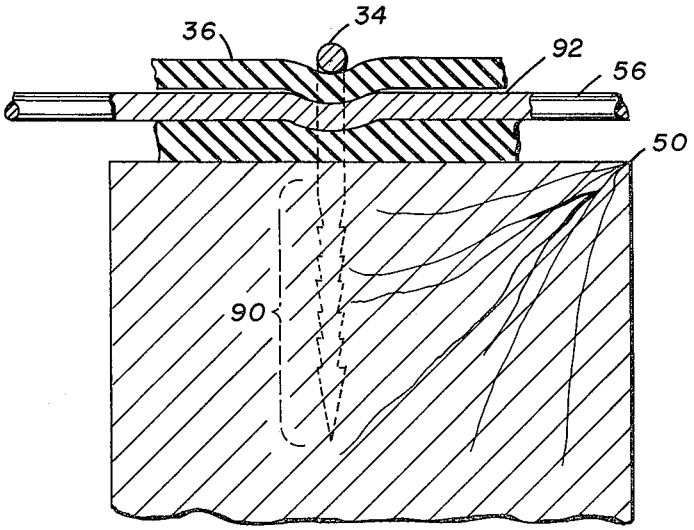
FIG. 5 is a side elevation in cross section taken along section lines 5—5 of FIG. 2.

Referring to FIG. 5, the insulator and staple assembly, 34 and 36 of FIGS. 1 and 2, is shown in cross section. In FIG. 5 it may be seen that the identical staple 34 having the barbed or serrated end 90 is employed in conjunction with the insulating tube 36; however, in this embodiment the staple firmly retains the fence wire. The tube 36 is preferably slit or split, in a manner not shown, so that it may be installed over the wire and then the staple 34 is driven into the post 50. The insulating tube 36 is provided with an inner diameter which is somewhat larger than the wire diameter 56, so that upon driving the staple 34 into the post 50, the insulator 34 and the wire 56 will be deformed and firmly held to the post.

As indicated above, the present invention, while being extremely secure, is still not infallible and a criminal of a very sophisticated nature could be successful in gaining access to a fenced area. The manner which may appear to be most obvious to such criminal would be to provide an electrical short circuit on each wire between two posts so that when the fence wire is cut between the posts the flow of current will not be interrupted and the alarm condition will not be included. However, the intruder must be thoroughly familar with the inventive system so as to stabilize the tightly secured wire so that when he cuts them between the electrical short circuits the wires will not slip through the loose intermediate post staples 38 and contact each other at some other point. Additionally, if the wire connections of the electrical short circuits of the intruder do not have almost the identical resistance as the fence wires, the detection circuit will detect a change in current, since the detection circuit may employ solid-state comparators and the like, which are sensitive to changes in hundredths of a volt.

The above description is presented by way of example only and is not intended to limit the scope of the present invention except as set forth in the following claims. For example, although the invention has been described as being formed by a pair of wires, a single wire could be employed and arranged in a serpentine path, with the current in the wire again being sensed to detect an intrusion which would alter the original length of the current path.

What is claimed is:

1. A security fence comprising:

a plurality of posts vertically arranged in the earth in a spaced-apart relationship and defining the area to be fenced;

two wires arranged in a spaced-apart pair consecutively affixed to each of said plurality of posts and being directionally reversed in a predetermined manner at the last of said plurality of posts and continuing in such fashion until the top of the last post is reached, said two wires being electrically continuous and said predetermined manner being such that unlike wires are adjacent one another, the wires being arranged on the post such that the vertical distance between the wires in relation to the distance between the posts is such that upon exerting mechanical force on the wires unlike wires will be brought into contact with one another;

said plurality of posts being arranged such that there are intermediate posts located between end posts which define said area to be fenced, and wherein said wires are firmly affixed to said end posts such that no relative motion between the wires and the end posts is possible and the wires are affixed to said intermediate posts such that said wires are permitted to slip horizontally in relation to said intermediate posts;

said wires being affixed to said intermediate posts by affixing means comprising a staple enclosing a non-conducting insert having an aperture therein of diameter substantially larger than the diameter of said wires;

power supply means connected to said two wires for supplying a voltage across the wires;

detection means connected to the opposite ends of said two wires for detecting when the current flowing through said two wires deviates from a preselected value; and alarm means connected to said detection means for providing an alarm when said deviation from said preselected value is detected by said detection means.

2. The security fence of claim 1, wherein, said staple means have barbed ends thereon to prevent removal from the posts upon installation therein.

3. The security fence of claim 1, wherein said wires comprise 14 gauge wire and said posts are arranged such that they are separated by at least 20 feet, wherein said wires are arranged on said post at a spacing of three inches.

4. The security fence of claim 1 further comprising tensioning means arranged in at least one of said wires for causing said wires to be approximately equally spaced one from another.

5. The security fence of claim 1, wherein at least one of said wires is provided with a notch formed by the removal of a portion of the metal forming the wire.

6. The security fence of claim 1, wherein said wires are directionally reversed by means of insulators placed over the wires at the location thereof contacting said last post, the thus insulated wires being firmly affixed to said last post and said insulated wires being crossed such that the wire of the pair which was originally bottom-most is arranged above and adjacent to the wire which was originally top-most.

7. The security fence of claim 1, wherein said detection means comprises a voltage comparator having a variable reference voltage means for producing an output when the current flowing in said two wires deviates from said preselected value as determined by said reference voltage means.

8. A fence comprising:

a plurality of posts arranged in the earth and defining an area to be fenced;

a pair of wires affixed to each of said posts in succession in a first direction forming a first fence pair and then being reversed and arranged in spaced-apart relationship to said first fence pair and affixed to each of said posts in succession in a direction opposite to said first direction and forming a second fence pair;

said plurality of posts being arranged having end posts and intermediate posts located therebetween, said wires being firmly affixed to said end posts by means of a deformable insulator and a staple means such that no relative motion is possible between said wires and said end posts and said wires being slidingly affixed to said intermediate posts by staple means having an insulating insert with an aperture therein and having the wire passing therethrough, said aperture being substantially larger than the diameter of the wire such that relative motion between said wires and said intermediate posts is possible;

a power supply means connected to first ends of said pair of wires for impressing a voltage thereacross;

detection means connected across the other ends of said pair of wires for detecting the current flowing therein and for producing an output signal upon detecting a current deviation from a preselected value; and alarm means receiving said output signal and producing an alarm.

9. The fence of claim 8, wherein said staple means is formed having barbed ends for inhibiting the removal thereof from said posts after installation.

10. The fence of claim 8, further comprising tubular insulating means arranged over said wires at the location where said wires are reversed, said wires and said tubular insulating means being firmly affixed to said posts by staple means.

11. The fence of claim 8, wherein at the location said wires are reversed, they are arrranged such that the top and bottom relationship of said two wires forming said first fence pair remains the same in said second fence pair.

12. The fence of claim 8, wherein at least one of said wires is formed having at least one notch whereat metal is removed from the outer diameter of the wire, whereby the tensile strength of the wire is decreased.

* * * * *